US006547074B1

(12) United States Patent
Chen

(10) Patent No.: US 6,547,074 B1
(45) Date of Patent: Apr. 15, 2003

(54) TOOL BOX HAVING PIVOTAL INNER FRAMES

(76) Inventor: Chang-Ying Chen, No. 5, 320 Alley, Shi Hu Road, Ta Li Hsiang, Taichung Hsien (TW)

( * ) Notice: Subject to any disclaimer, the term of this patent is extended or adjusted under 35 U.S.C. 154(b) by 12 days.

(21) Appl. No.: 09/986,495

(22) Filed: Nov. 9, 2001

(51) Int. Cl.[7] ..... B65D 85/28
(52) U.S. Cl. ..... 206/379; 206/743; 206/755
(58) Field of Search ..... 206/378, 379, 206/742, 743, 755; 211/69

(56) References Cited

U.S. PATENT DOCUMENTS 5,746,316 A * 5/1998 La Barre ..... 206/379
5,813,531 A * 9/1998 Kao ..... 206/373
5,813,533 A * 9/1998 Knoblauch ..... 206/379
5,893,457 A * 4/1999 Wei ..... 206/373
6,105,770 A * 8/2000 Vasudeva ..... 206/378
6,283,291 B1 * 9/2001 Vasudeva et al. ..... 206/373
6,415,923 B1 * 7/2002 Chen ..... 206/379

* cited by examiner

*Primary Examiner*—David T. Fidei
(74) *Attorney, Agent, or Firm*—Rosenberg, Klein & Lee

(57) ABSTRACT

A tool box includes a base and a cover is pivotally connected to the base by extending two shafts through two sides of the base and two lugs of the cover. An inner frame has two sidewalls and a rack is connected between the two sidewalls. A plurality of recesses are defined in the rack for receiving tools therein. A slot is defined through each of the sidewalls and two operation members are connected between the two sidewalls and the two lugs. The two shafts extend through the two operation members and two respective ends of the two sidewalls. Each of the operation members has a protrusion which is engaged with the slot corresponding thereto so that when the cover is opened to a certain degree, the rack is pivoted upward.

5 Claims, 5 Drawing Sheets

TOOL BOX HAVING PIVOTAL INNER FRAMES

FIELD OF THE INVENTION

The present invention relates to a tool box that has two pivotal inner frames which are pivoted upward together with the opening of the cover.

BACKGROUND OF THE INVENTION

Many conventional tool boxes include a base and a cover which is pivotally connected to the base. The base and the cover have recesses for receiving tools therein. However, the users have to pick the tools or the bits by his/her finger from the recesses and there is only a limited space to allow fingers to insert therein. Besides, the number of the recesses is limited if the recesses are defined in the base and the cover. Some tool boxes have an inner frame which is pivotally connected to the base so that more tools can be stored in the tool boxes. Nevertheless, there is a complicated structure to set the inner frame in the tool box and this complicated structure generally includes many thin and tiny parts which are easily to be broken when using the tool boxes.

SUMMARY OF THE INVENTION

In accordance with one aspect of the present invention, there is provided a tool box which comprises a base and a cover is pivotally connected to the base. Two lugs extend from the cover and two shafts extend through two sides of the base and the two lugs. An inner frame has two sidewalls and a rack is connected between the two sidewalls. A slot is defined through each of the sidewalls and two operation members are connected between the two sidewalls and the two lugs. The two shafts further extend through the two operation members and two respective ends of the two sidewalls. Each of the operation members has a protrusion which is engaged with the slot corresponding thereto.

The primary object of the present invention is to provide a tool box that has an inner frame which is pivoted upward when the cover is opened wide.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
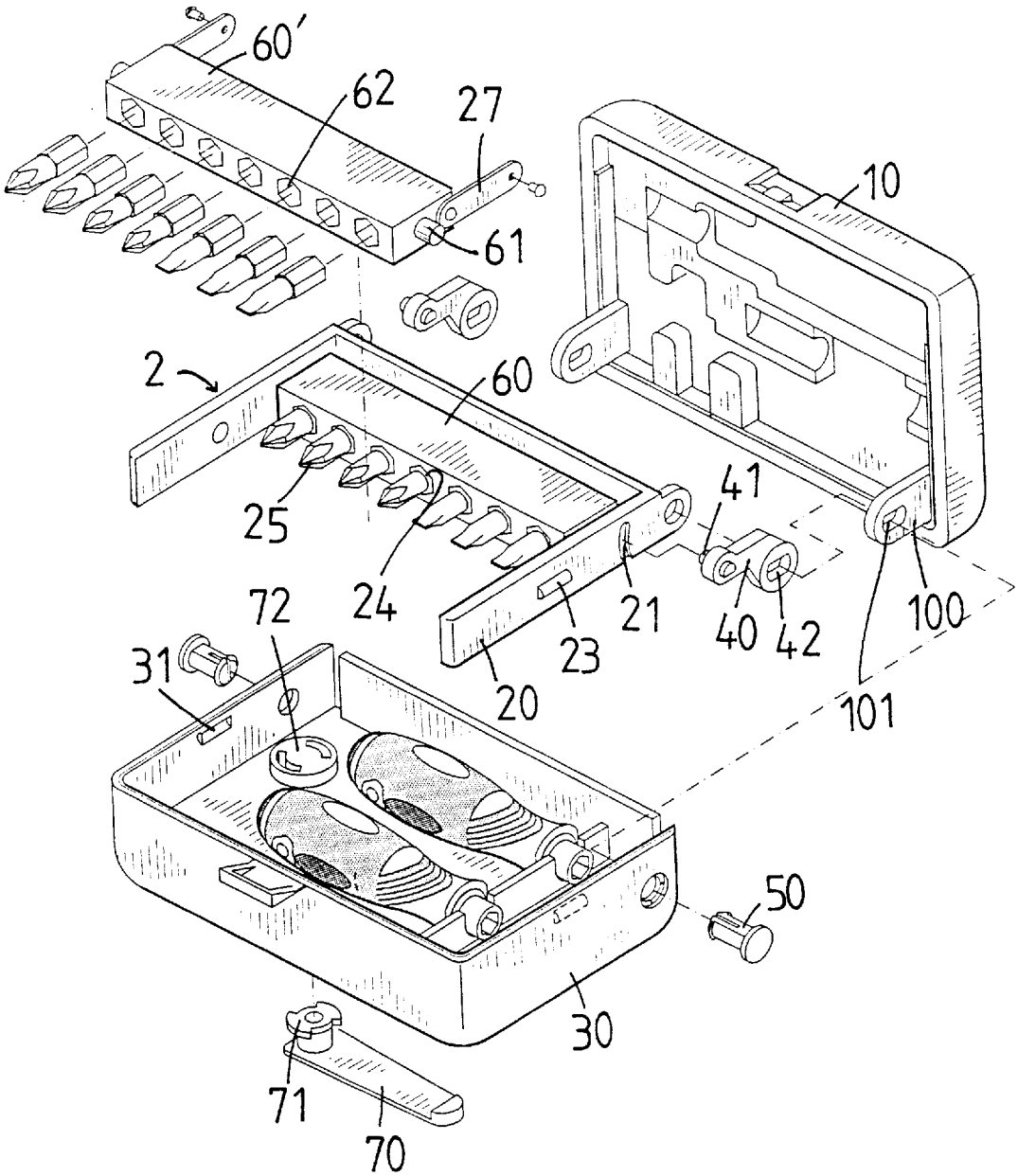
FIG. 1 is an exploded view to show the tool box of the present invention.
Figure 2:
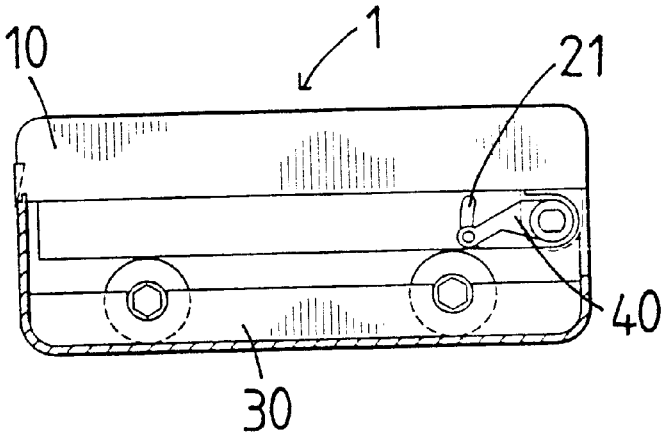
FIG. 2 is an end view to show the protrusion of the operation members is located at a lower position of the slot.

Referring to FIGS. 1 and 2, the tool box 1 of the present invention comprises a base 30 and a cover 10 is pivotally connected to the base 30. The base 30 has four sides and one of which has two slits so as to receive two lugs 100 on the cover 10. The base 30 has recesses for receiving tool handles. Two notches 31 are defined in two opposite insides of the base 30. Two shafts 50 extend through the two opposite sides of the base 30 and the two lugs 100.

Figure 7:
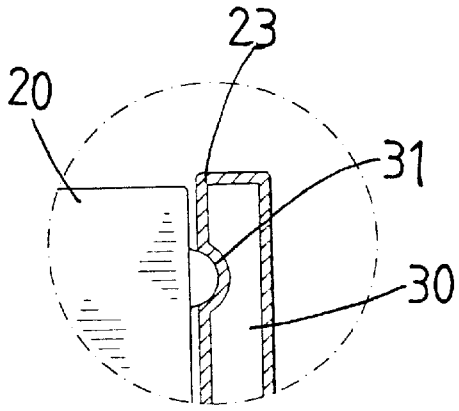
FIG. 7 is a cross sectional view to show the two sidewalls of the inner frame engaged with the two notches in the base of the tool box.

An inner frame 2 has two sidewalls 20 and a first rack 60 is connected between the two sidewalls 20. A plurality of recesses 24 are defined in the first rack 60 so as to receiv bits 25 therein. A slot 21 is defined through each of the sidewalls 20 and two operation members 40 are connected between the two sidewalls 20 and the two lugs 100. The two shafts 50 further extend through the two operation members 40 and two respective ends of the two sidewalls 20. Each of the operation members 40 has a protrusion 41 which is engaged with the slot 21 corresponding thereto. The two lugs 100 and the two operation members 40 each have an elongate hole 101/42, the two shafts 50 each having two plain surfaces which are matched with the elongate holes 101, 42. The two sidewalls 20 each have a rib 23 extending from an outside thereof so as to be disengagably received in the two notches 31 as shown in FIG. 7. The inner frame 2 is well positioned in the base 30.

A second rack 60' has two rods 61 on two ends thereof and the second rack 60' is pivotally connected between the two sidewalls 20. Two links 27 are pivotally connected between the first rack 60 and the second rack 60'. The second rack 60' has a plurality of recesses 62 for receiving bits therein.

Figure 3:
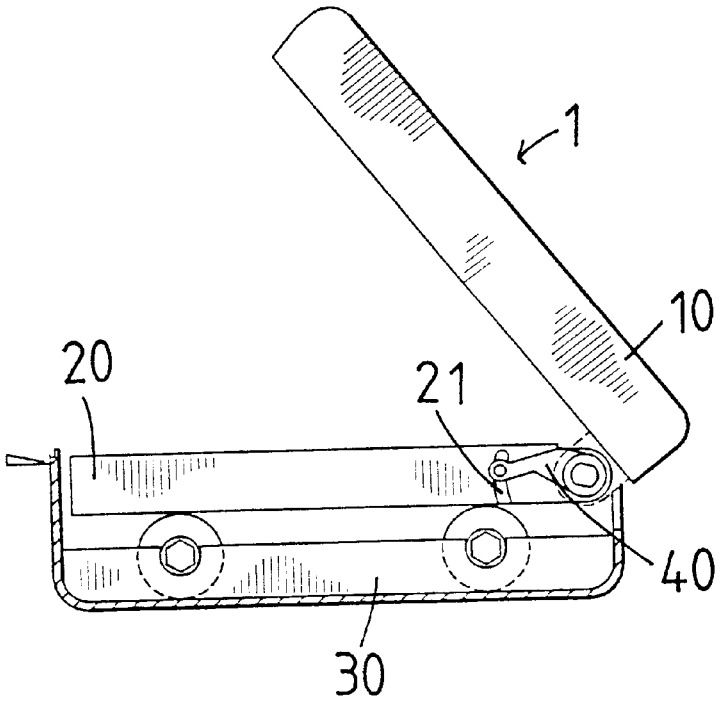
FIG. 3 is an end view to show the protrusion of the operation members is moved to a higher position of the slot when the cover is opened.
Figure 6:
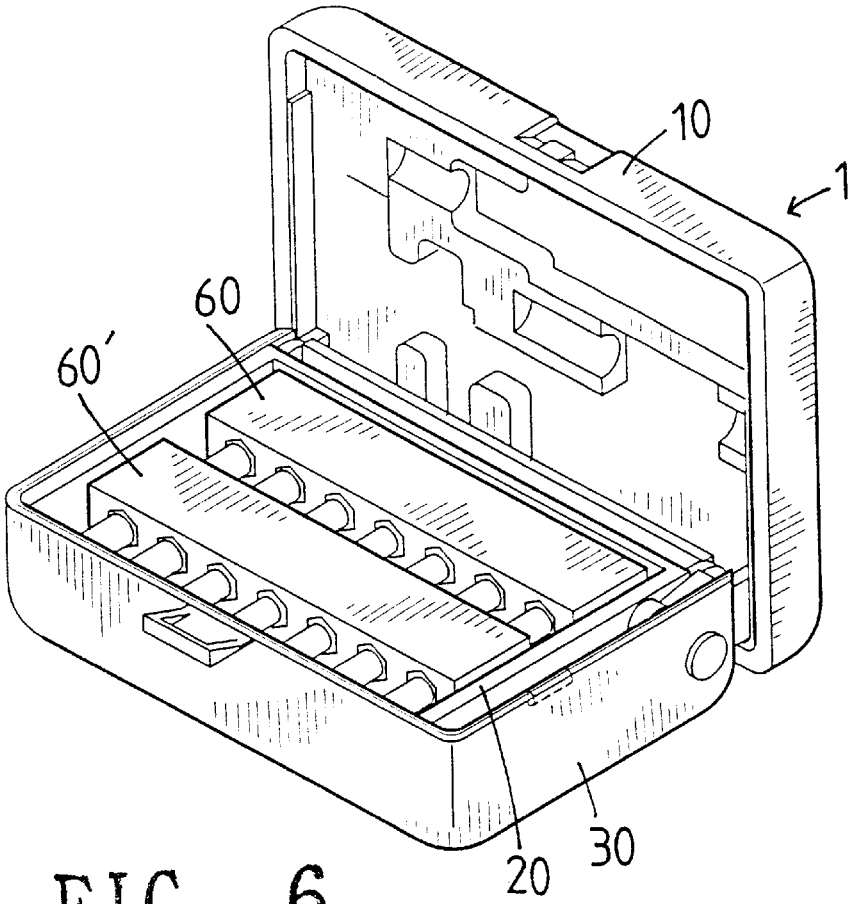
FIG. 6 is a perspective view to show the inner frame is not pivoted if the cover is not opened wide.

As shown in FIGS. 3 and 6, when opening the cover 10, the protrusions 41 move in the slots 21 and the inner frame 2 is not pivoted when the protrusions 41 do not move to the respective ends of the slots 21.

Figure 4:
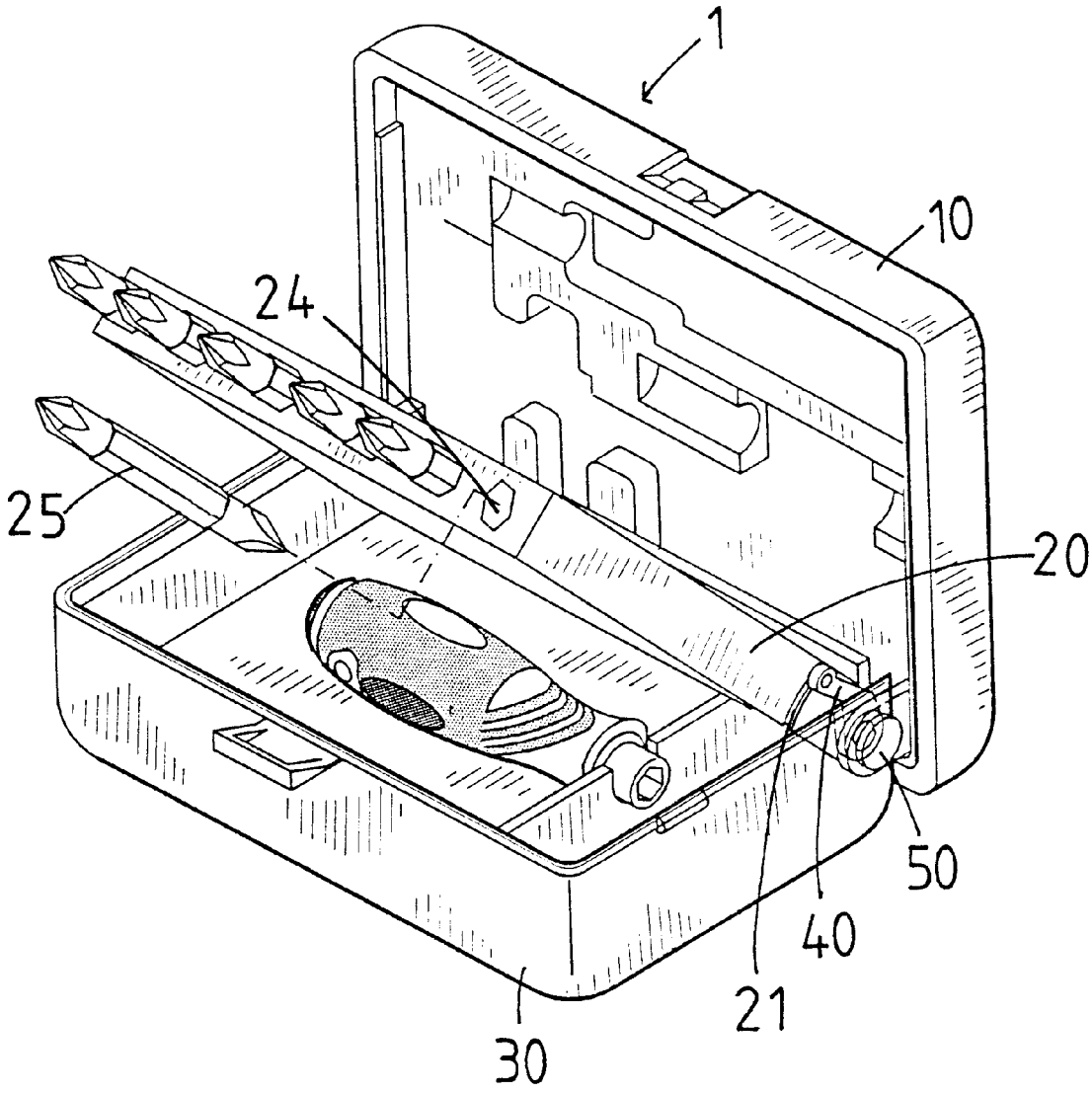
FIG. 4 shows that the inner frame is pivoted upward when the cover is opened.
Figure 5:
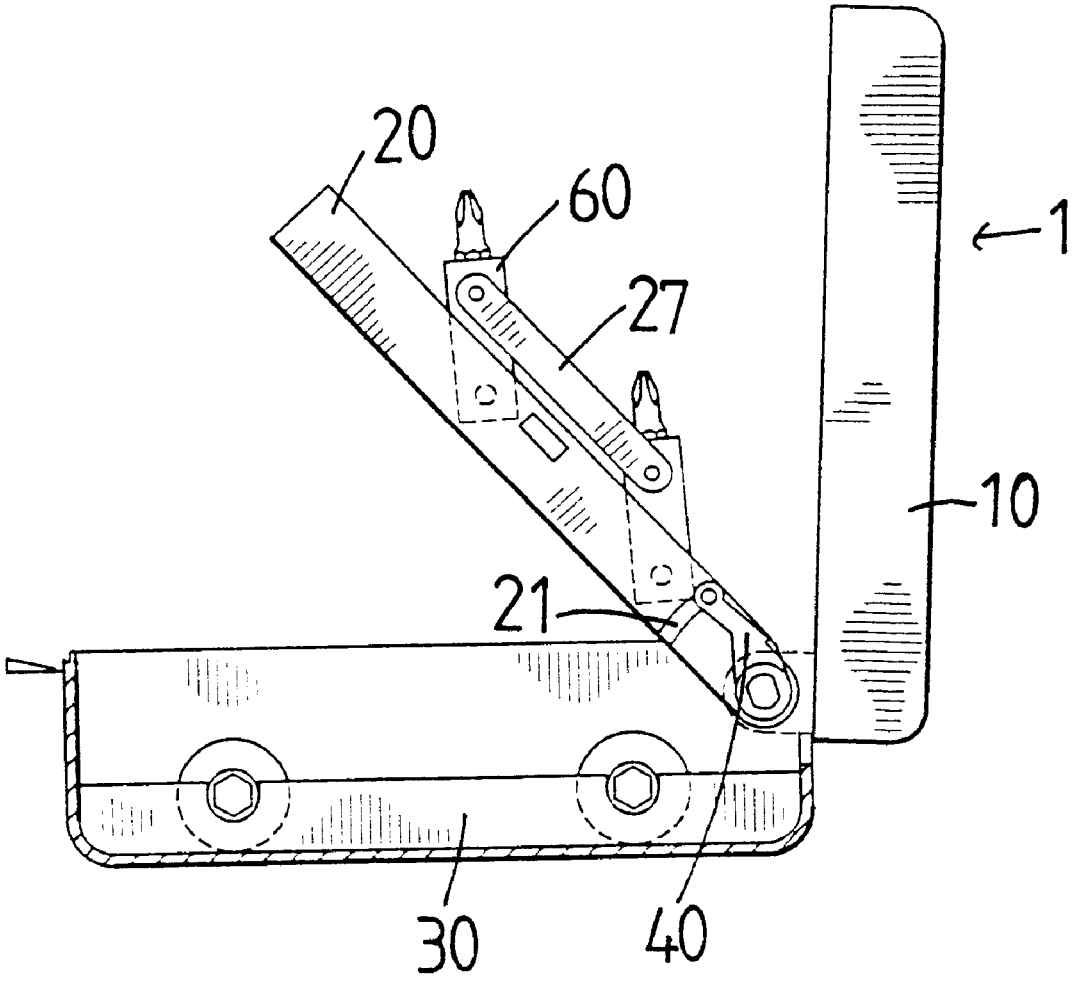
FIG. 5 is a side view to show the two racks are pivoted upward when the cover is opened.

As shown in FIGS. 4 and 5, when the protrusions 41 move to touch the ends of the slots 21, the inner frame 2 is pivoted upward together with the opening of the cover 10. The users may pivot the first rack 60 and the second rack 60' to pick the desired bits 25.

A clamp member 70 has an engaging head 71 extending from a side thereof and a receiving port 72 is connected to an underside of the base 30 so that the engaging head 71 is engaged with the receiving port 72. The clamp member 70 allows the tool box to be conveniently clamped to the user's belt.

While we have shown and described the embodiment in accordance with the present invention, it should be clear to those skilled in the art that further embodiments may be made without departing from the scope of the present invention.

What is claimed is:

1. A tool box comprising:

a base;

a cover pivotally connected to said base and having two lugs extending therefrom, two shafts extending through two sides of said base and said two lugs, and an inner frame having two sidewalls and a first rack connected between said two sidewalls, a plurality of recesses defined therein, a slot defined through each of said sidewalls and two operation members connected between said two sidewalls and said two lugs, said two shafts further extending through said two operation members and two respective ends of said two sidewalls, each of said operation members having a protrusion which is engaged with said slot corresponding thereto.

2. The tool box as claimed in claim 1, wherein said two lugs and said two operation members each have an elongate hole, said two shafts each having two plain surfaces which are matched with said elongate holes.

3. The tool box as claimed in claim 1, wherein said two sidewalls each have a rib extending from an outside thereof and two notches defined in two opposite inner sides of said base, said two ribs disengagably received in said two notches.

4. The tool box as claimed in claim 1 further comprising a second rack pivotally connected between said two sidewalls and two links pivotally connected between said first rack and said second rack.

5. The tool box as claimed in claim 1 further comprising a clamp member which has an engaging head extending from a side thereof, a receiving port connected to an underside of said base and said engaging head engaged with said receiving port.

* * * * *

UNITED STATES PATENT AND TRADEMARK OFFICE

CERTIFICATE OF CORRECTION

PATENT NO. : 6,547,074 B2
DATED : June 3, 2003
INVENTOR(S) : Bolasna et al.

It is certified that error appears in the above-identified patent and that said Letters Patent is hereby corrected as shown below:

Column 5,
Line 58, replace the word “wailing” with the word -- trailing --.

Column 6,
Line 35, replace the word “fanned” with the word -- formed --.
Line 51, replace the word “pacts” with the word -- pads --.
Line 66, replace the word “packet” with the word -- pocket --.

Column 7,
Line 30, replace the word “tote” with -- to the --

Signed and Sealed this

Seventh Day of October, 2003

JAMES E. ROGAN
*Director of the United States Patent and Trademark Office*